US006963254B1

(12) United States Patent
How

(10) Patent No.: US 6,963,254 B1
(45) Date of Patent: Nov. 8, 2005

(54) METHOD AND APPARATUS OF OBTAINING UNIFORM COUPLING FROM A NONRECIPROCAL RESONATOR

(76) Inventor: Hoton How, 262 Clifton St., Belmont, MA (US) 02478

( * ) Notice: Subject to any disclaimer, the term of this patent is extended or adjusted under 35 U.S.C. 154(b) by 54 days.

(21) Appl. No.: 10/798,054

(22) Filed: Mar. 12, 2004

(51) Int. Cl.[7] ..... H01P 1/32
(52) U.S. Cl. ..... 333/24.1; 333/102
(58) Field of Search ..... 333/24.1, 102

(56) References Cited

U.S. PATENT DOCUMENTS 6,483,393 B1 * 11/2002 How ..... 333/24.1

* cited by examiner

*Primary Examiner*—Stephen E. Jones

(57) ABSTRACT

Disclosed are one method and one apparatus which enable a non-reciprocal microwave resonator to be coupled in and out at various positions showing the circular symmetry. As such, the transmission phase, but not the amplitude, can be varied, resulting in the operation of a digital phaser. The resonator is electrically connected to two network feeders each of which provides separate phase selectivity. The overall phase selectivity of the phaser is the product of the selectivities of these two network feeders, resulting in a less volume, and hence reduced fabrication costs.

17 Claims, 6 Drawing Sheets

Figure 1:
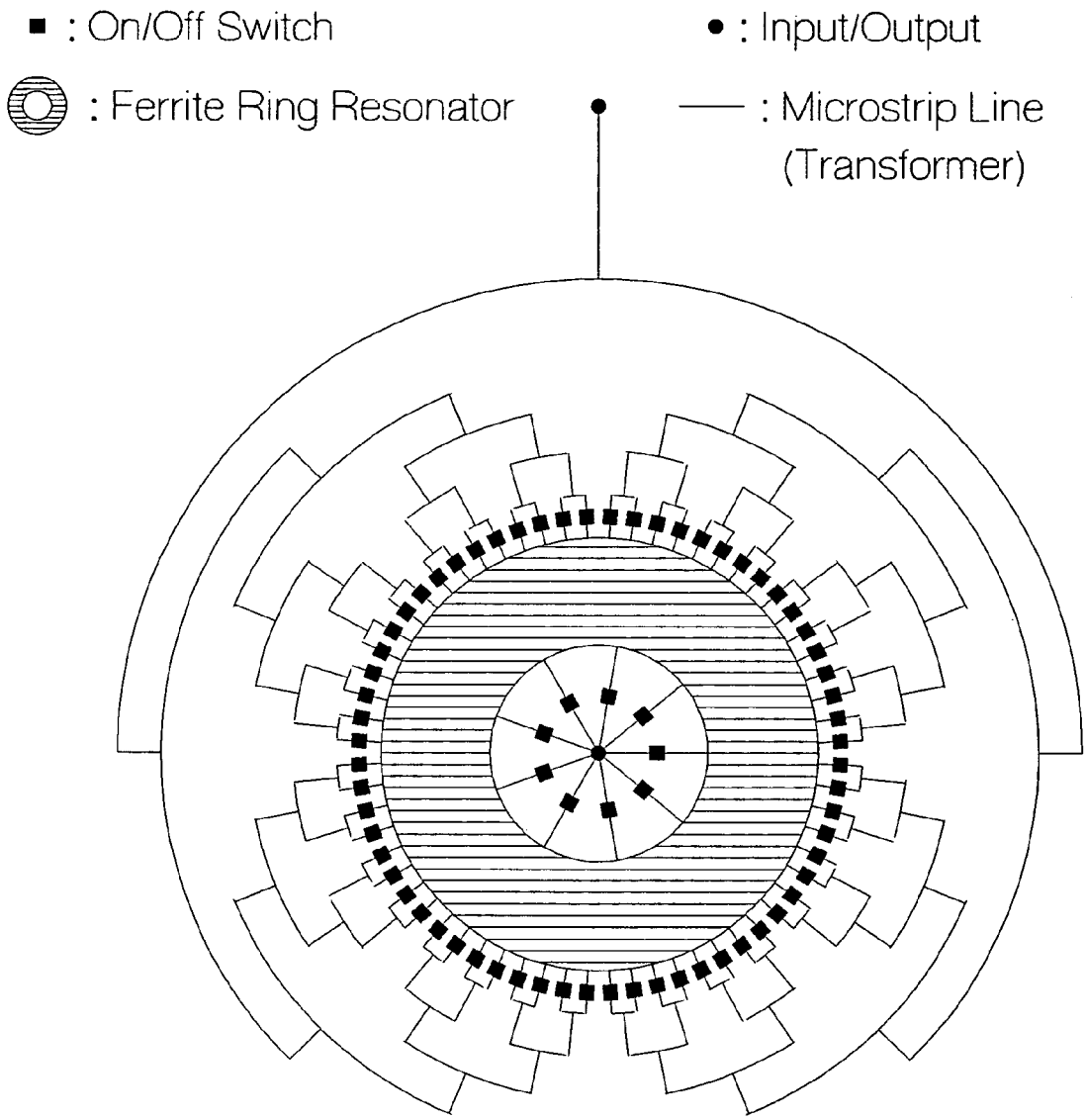

METHOD AND APPARATUS OF OBTAINING UNIFORM COUPLING FROM A NONRECIPROCAL RESONATOR

FEDERALLY SPONSORED RESEARCH (Not Applicable)

SEQUENCE LISTING OR PROGRAM (Not Applicable)

BACKGROUND

1. Field of Invention

This invention is directed to a method and an apparatus to obtain uniform coupling in and out from a nonreciprocal resonator supporting single-mode operation. Switches are inserted with inner and outer feeder networks so that unique phases result exhibiting symmetry. As such, the circuit of a digital phaser gives nominally constant insertion loss over phase selection.

2. Prior Art

The prior art U.S. Pat. No. 6,483,393 B1 by the same author disclosed method and apparatus of obtaining phase shift using non-reciprocal resonator. However, the prior art did not specify, in explicit examples, the necessary feeder networks coupling in and out a nonreciprocal resonator so as to achieve the desired phase shift operation. Although it is possible, by all means, to realize the phaser operation by incorporating transmission lines of an equal electrical length, microwave circuits obtained in this manner are bulky and impractical, resulting in high insertion losses and high costs.

OBJECTS AND ADVANTAGES

Accordingly, it is an object of the invention to address one or more of the foregoing disadvantages or drawbacks of the prior art, and to provide such improved method and apparatus to obtain practical feeder networks, coupling in and out from a nonreciprocal resonator showing circular symmetry thereby enabling the phaser operation yielding a constant insertion loss. In other words the present invention complements the prior art by teaching in explicit examples how circular symmetry can be maintained by using feeder networks with which switches are deployed so as to uniquely specify signal paths, and hence phases, characterized by the same insertion loss, rendering efficiency and elegance, thereby furnishing compactness and economy.

Other objects will be apparent to one of ordinary skill, in light of the following disclosure, including the claims.

SUMMARY

In one aspect, the invention provides a method which uses one inner feeder network and one outer feeder network to jointly select the phase of a signal path encompassing a non-reciprocal resonator. These networks provide the same electrical length respectively and the selection action is accomplished by switches. The inner feeder network takes the form of a radial branch, and the outer feeder network takes the form of a binary divider, both of which exhibit the circular symmetry thereby admitting uniform operation. Switches can be the single-pole M-throw type or the On-Off type, or in combination, and M denotes an integer.

In another aspect, the invention provides an apparatus which uses one inner feeder network and one outer feeder network to jointly select the phase of a signal path encompassing a non-reciprocal resonator. The non-reciprocal resonator is formed with a ferrite or a dielectric resonator assuming the ring or the disk geometry. For a dielectric resonator the outer feeder network is also used to induce non-reciprocity for wave propagation at resonance. The inner feeder network takes the form of a radial branch, and the outer feeder network takes the form of a binary divider, both of which exhibit the circular symmetry thereby admitting uniform operation. Switches can be the single-pole M-throw type or the On-Off type, or in combination, and M denotes an integer.

DRAWINGS

Figures

For a more complete understanding of the nature and objectives of the present invention, reference is to be made to the following detailed description and accompanying drawings, which, though not to scale, illustrate the principles of the invention, and in which:

FIG. 1 shows one example of the preferred embodiment of the invention that 576 digital phases are induced from a ferrite ring resonator supporting single-mode operation. In this example the outer feeder network assumes the form of a 6-fold divider and the inner feeder network consists of a 9-radial branch. On-Off switches are used in this example.

Figure 2:
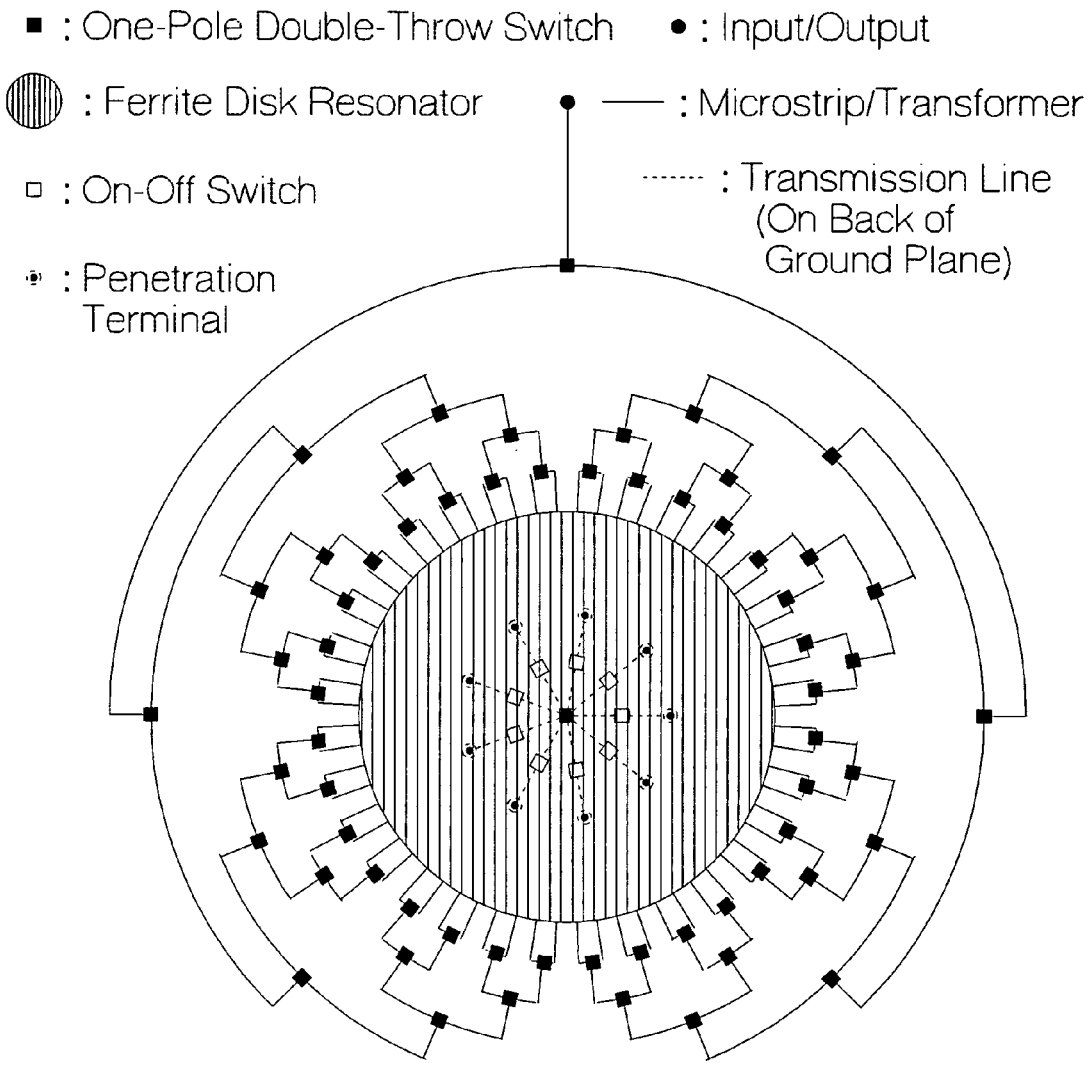

FIG. 2 shows a similar example of FIG. 1 of the preferred embodiment of the invention that the ring geometry of the resonator is replaced by a disk. As such, the inner feeder network has to be placed under the disk resonator feeding into the disk resonator using penetration terminals. Phases are selected via On-Off switches inserted with the inner feeder network and SPDT switches inserted with the outer feeder network.

Figure 3:
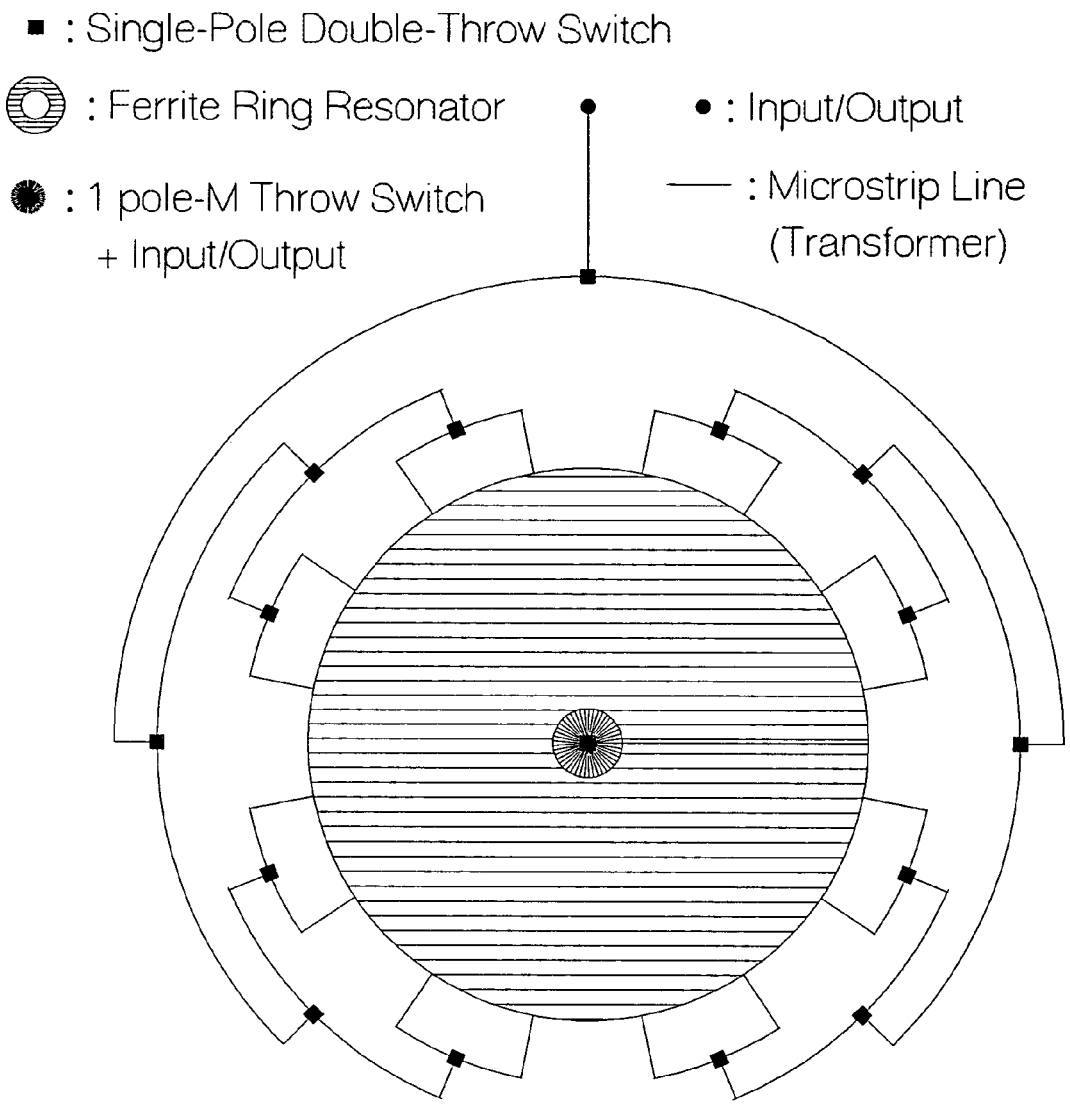

FIG. 3 shows a similar example of FIG. 1 of the preferred embodiment of the invention that the inner feeder network incorporates a radial branch utilizing an SPMT switch and the outer feeder network incorporates a 4-fold divider utilizing SPDT switches. Here, M denotes an integer. The resultant digital phases are therefore 16·M.

Figure 4:
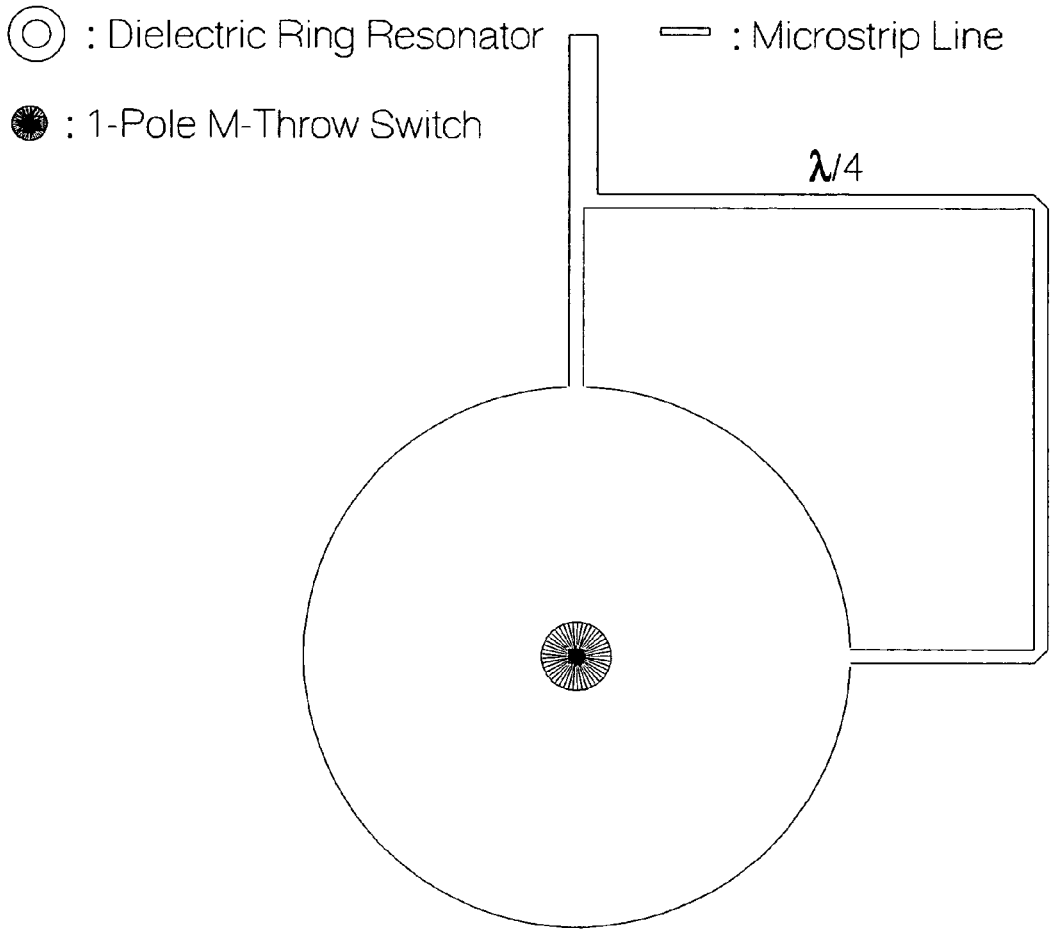

FIG. 4 shows a similar example of FIG. 3 of the preferred embodiment of the invention that the ferrite resonator is replaced by a dielectric resonator. In order to induce non-reciprocity in wave propagation at resonance the outer feeder network has to supply dual orthogonal feedings at phase quadrature. The inner feeder network incorporates a radial branch utilizing an SPMT switch and the resultant digital phases are therefore 1·M. Here, M denotes an integer.

Figure 5:
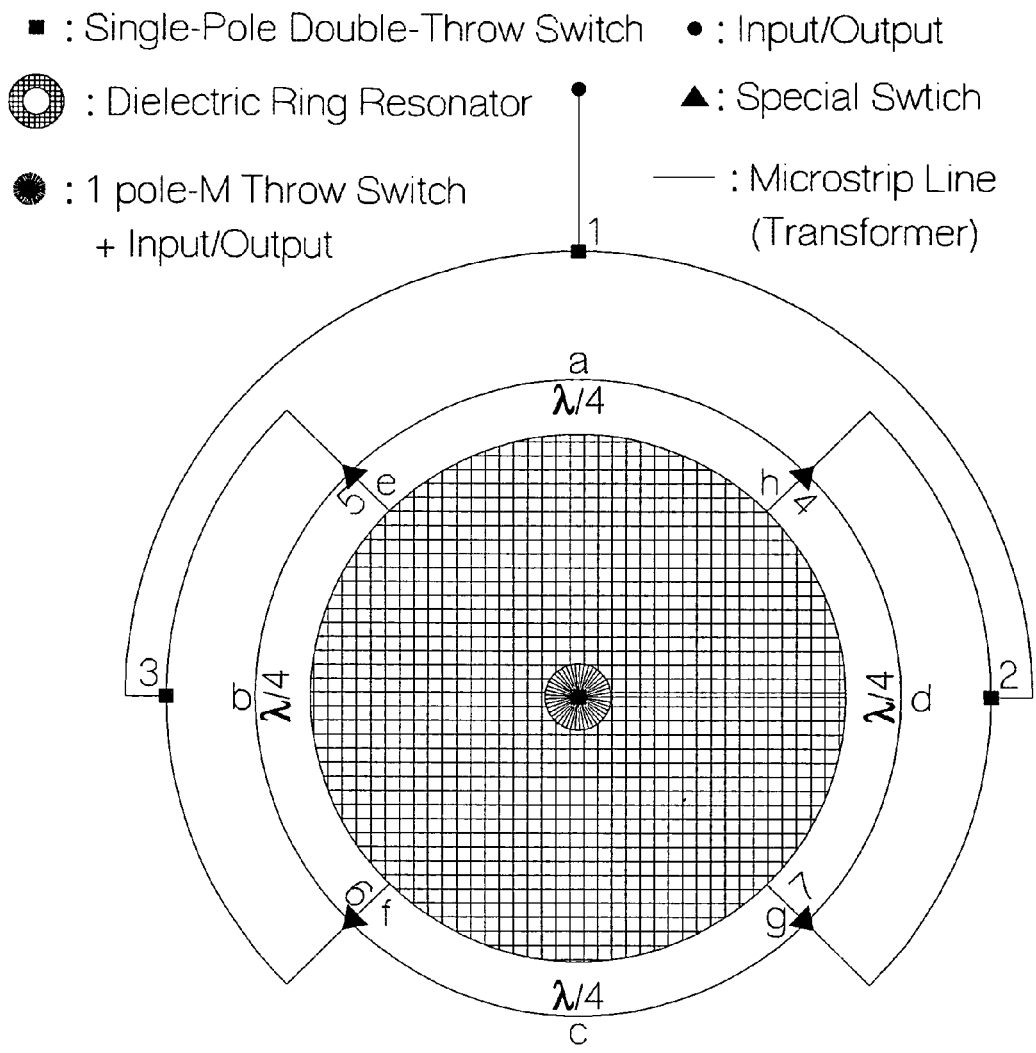

FIG. 5 shows a similar example of FIG. 4 of the preferred embodiment of the invention that more phase selectivity is provided with the outer feeder network. In order to induce non-reciprocity in wave propagation at resonance the outer feeder network has to supply dual orthogonal feedings at phase quadrature, as well as to provide phase selectivity. The resultant digital phases are 4·M. Here, M denotes an integer.

Figure 6:
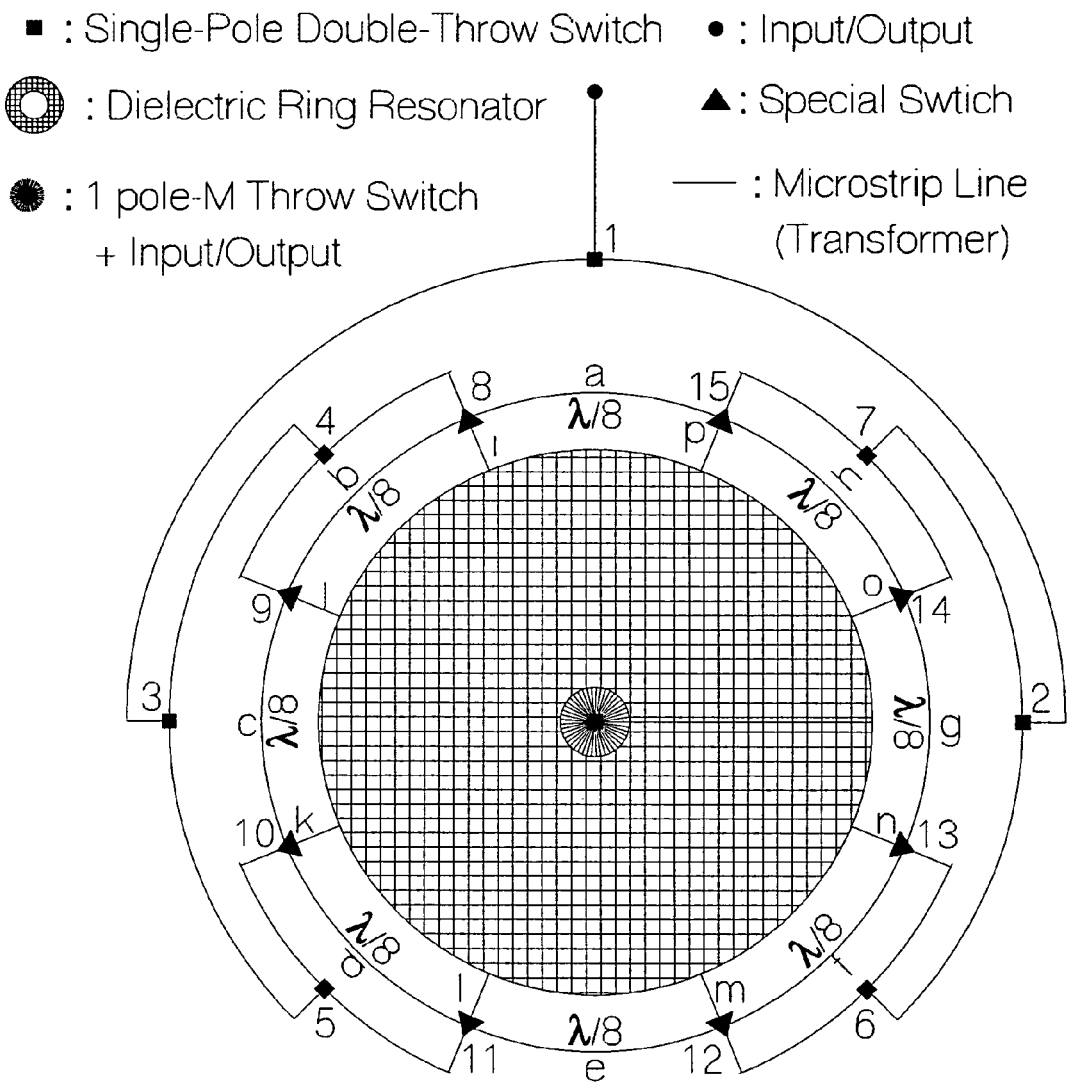

FIG. 6 shows a similar example of FIG. 5 of the preferred embodiment of the invention that the phase selectivity provided by the outer feeder network is doubled. The resultant digital phases are thus 8·M. Here, M denotes an integer.

DETAILED DESCRIPTION

Preferred Embodiment:—FIG. 1

FIG. 1 shows one example of the preferred embodiment of the invention that a microstrip ferrite ring resonator supporting non-reciprocal wave propagation at resonance is coupled in and out via two feeder networks. The inner feeder network assumes a 9-radial branch, and the outer feeder network assumes a 6-fold binary divider. Here an M-radial branch means M transmission lines joining each other leading to a common vertex point, and an N-fold binary divider means a network consisting of power splitting/combining transmission lines cascading at N folds, and M and N are both integers. Note that M branch arms, or transmission lines, do not necessarily to intersect all at one point, as plotted in FIG. 1; they may join each other first individually before leading to a common vertex point. In FIG. 1 the transmission lines considered are microstrip lines, and M=9 and N=6. Of course, M and N can take other integer numbers, and other kind of transmission lines, such as strip lines, inverted/suspended microstrip lines, etc., can be equally considered. This implies that $2^6 \times 9$ (=576) discrete phases can be selected from these two feeder networks via the use of switches. Note that symmetry has been reinforced with the construction of these two feeder networks so that uniform operation of the phaser in insertion loss is guaranteed, being nominally a constant value independent of the angle in phase shift. In FIG. 1 the switches are On-Off switches, and on selecting a phase one switch from each of the networks is switched on, and the others switched off.

In FIG. 1 9 inner paths and $2^6$ (=64) outer paths are subject to selection. It may be questioned if 8, for example, inner paths are presented instead of 9. As such, phase selection becomes redundant, if these 8 inner feeder paths show up with symmetry, say, to intersect each other to form an equal angle. To avoid this difficulty, one may argue to displace these 8 inner radial paths to slightly remove the symmetry, say, to vary the intersection angles to be all different, by an extent of $2\pi/(64\times8)$ as well as its integer multiples (from 2 to 8). This suffices, but not to represent the optimal condition, since symmetry is broken by the thus-obtained inner radial feeder network, although insignificantly. The optimal condition is that the M inner paths are arranged at symmetry and the greatest common factor of $2^N$ and M is 1, where N denotes the order of the binary Divider of the outer feeder network.

Therefore, the input signal is, say, fed at the center of the ferrite ring resonator of FIG. 1, being selected by closing one of the switches inserted with the inner radial feeder network, traveling down or up the ferrite ring resonator depending on the bias-field direction, to be selectively coupled out by closing one of the switches inserted with the outer N-fold binary feeder network. Or, equivalently, input signal can enter from the terminal of the outer feeder network, following a path which is selected by closing one of the switches therein, traveling up or down the ferrite ring resonator depending on the bias-field direction, to be selectively coupled out at the center of the ferrite ring resonator of FIG. 1 by closing one of the switches inserted with the inner feeder network. As a common practice, transformers can be included with the networks, as well as other microwave components such as amplifiers and attenuators, so long as the symmetry assumed by the inner and the outer feeder networks is not violated. Switches can be turned on and off electronically, such as to apply a current, a voltage, or a laser light, invoking transistor junctions, semiconductor diodes, photoconductors, superconducting states, and micro-electro-mechanical systems (MEMSs). The inner and the outer feeder networks of FIG. 1 couple to the ferrite ring resonator electrically, either inductively, capacitively, or conductively, or in combination. Fabrication of switches can be integrated with the microstrip feeder networks employing the printing-circuit techniques, such as low-temperature cofire ceramics (LTCC) techniques, thereby facilitating cost reduction Frequency tuning can be obtained if the bias magnetic field is changed, which is expressed onto the ferrite ring resonator shown in FIG. 1.

Preferred Embodiment:—FIG. 2

FIG. 2 shows a similar example of FIG. 1 of the preferred embodiment of the invention that a ferrite disk resonator, rather than a ferrite ring resonator, is considered. Because there is no room for the inner feeder network considered in FIG. 1 to be inserted at the center of the ferrite disk of FIG. 2, the inner feeder network has to be placed outside the resonator, for example, directly below the ground plane. The inner feeder network takes the form of a radial branch consisting of 9 signal paths to be selected using the On-Off switches inserted therein. The inner feeder network can be of any kind, such as coax lines, microstrip lines, or striplines, and the radial branch feeds the ferrite disk resonator via penetration terminals. A penetration terminal means the center conductor of the feeder penetrates through the ferrite substrate to be electrically connected with the microstrip patch of the resonator, as commonly practiced by feeding a microstrip patch antenna. In FIG. 2 the outer feeder network assumes the same binary divider structure, except that SPDT (Single-Pole Double Throw) switches are used, instead of the On-Off switches which are used in FIG. 1. Thus, by switching on the SPDT switches in each of the stages of the cascaded structure of the outer feeder network and switching off the remaining SPDT switches, a unique signal path is selected, connected to the ferrite disk resonator attaining a specific phase. In FIG. 2 the outer feeder network assumes a 6-fold binary divider and the inner feeder network assumes a 9-radial branch. It implies 576 digital phases can be selected, same as the phaser shown in FIG. 1. The other discussions associated with FIG. 1 can be equally applied here.

Preferred Embodiment:—FIG. 3

FIG. 3 shows a similar example of FIG. 1 of the preferred embodiment of the invention that an SPMT (Single-Pole M-Throw) switch is used with the inner feeder network inserted at the center of the ferrite ring resonator serving also as the input/output terminal. The outer feeder network assumes a 3-fold binary divider using SPDT switches in selecting a signal path, and hence a signal phase. That is, by selecting one signal path from the SPMT switch and one signal path from one of the cascaded stages of SPDT switches, a unique signal phase is obtained, and the phaser of FIG. 2 provides 16·M phases. For example, if M=45, there are thus totally-360 phases. The other discussions associated with FIG. 1 can be equally applied here.

Preferred Embodiment:—FIG. 4

FIG. 4 shows a similar example of FIG. 3 of the preferred embodiment of the invention that a dielectric ring resonator, instead of a ferrite ring resonator, is considered. In order to invoke non-reciprocity in wave propagation a magnetic field is required to bias a ferrite resonator; and dual feeding with phase quadrature needs to be applied with a dielectric resonator, as commonly practiced for the generation of circularly polarized radiations from a ferrite and a dielectric patch antennas, respectively. Thus, the outer feeder network considered by FIG. 3 is replaced by a dual-fed network in FIG. 4 consisting of two microstrip feeders in phase quadrature connected to the dielectric microstrip ring resonator at the peripheral edge at two orthogonal positions. Phase quaduature is realized through an extra path annotated in FIG. 4 as $\lambda/4$. In FIG. 4 the microstrip geometry is assumed, and the other planar geometries can be equally used, for example, the stripline geometry, the suspended/inverted microstrip geometry, etc. In FIG. 4 the outer feeder network involves no switches subject to no path selection, whereas the inner feeder network assumes a radial branch incorporating an SPMT switch at the center of the ring resonator, same as FIG. 3. As such, M phases can be selected from the dielectric phaser of FIG. 4. The other discussions associated with FIG. 1 can be equally applied here, except that the phaser operation of FIG. 4 is fixed in frequency possessing no frequency tuning capability, as in contrast to the other ferrite examples considered with FIG. 1, FIG. 2, and FIG. 3.

Preferred Embodiment:—FIG. 5

FIG. 5 shows a similar example of FIG. 4 of the preferred embodiment of the invention except that the outer feeder network is endowed with path, and hence phase, selectivity. That is, in FIG. 5 there are 4 possible selections for each rotational sense, clockwise or counterclockwise, and each selection is associated with one arc path and two respective enclosing adjacent edge paths. The arc path, denoted by a, b, c, d, is of a $\lambda/4$ electrical length, and the edge paths, denoted by e, f, g, h, separate arc paths a, b, c, d, being rotated 90° apart from each other, as shown in FIG. 5. Switch 1, 2, 3 are SPDT switches, which are used to select 1 among 4 selections with 90° phase difference in a sequential order, and 4, 5, 6, 7 are special switches, which reinforce the feeding condition required to induce non-reciprocity for wave propagation in the dielectric ring resonator. For example, when switches 1 and 3 are selected, arc paths b and edge paths f and g are activated by special switches 5 and 6, and the other arc paths a, c, d, and edge paths e and f are deactivated by special switches 4 and 7, as well as 5 and 6. When the inner feeder network provides M path selections employing an SPMT switch, the total available digital phases from the phaser of FIG. 5 is thus $4 \cdot M$. Here M is preferred to be an odd integer. FIG. 5 assumes the microstrip geometry. However, other planar geometries can be equally used, for example, the stripline geometry, the suspended/inverted microstrip geometry, etc. The other discussions associated with FIG. 1 can be equally applied here, except that the phaser operation of FIG. 5 is fixed in frequency possessing no frequency tuning capability, as in contrast to the other ferrite examples considered with FIG. 1, FIG. 2, and FIG. 3.

Preferred Embodiment:—FIG. 6

FIG. 6 shows a similar example of FIG. 5 of the preferred embodiment of the invention except that 8, instead of 4, phase selectivity is endowed with the outer feeder network of a dielectric ring resonator. In FIG. 6 SPDT switches 1, 2, 3, 4, 5, 6, 7 are used to select one phase value in a sequence of $\pi/4$, and special switches 8, 9, 10, 11, 12, 13, 14, 15 are used to activate the required signal paths to induce non-reciprocal operation of the dielectric ring resonator. For example, switches 1, 3, and 4 can be used to select the first phase corresponding to activation of the arc paths b, c, d, and edge paths i, l; the other arc paths, a, e, f, g, h, and the other edge paths, i, k, m, n, o, p, are all deselected, as collaboratively operated by special switches 8, 9, 10, 11, 12, 13, 14, 15. In FIG. 6 each arc path contributes a $\pi/8$ propagation phase, and hence two consecutive arc paths are needed under each selection to induce the required phase quadrature on orthogonal feeding. Other phases from the outer feeder network of FIG. 6 results in a similar manner.

The outer feeder network shown in FIG. 6 is a 3-fold binary divider, which gives a total of $2^3 \times M$ digital phases if an SPMT switch is used with the inner feeder network assuming a radial branch inserted at the center of the ring resonator. In general $2^N \times M$ digital phases can be obtained by employing an N-fold divider for the outer feeder network and an M-radial branch for the inner feeder network, similar to the phase incorporating a ferrite ring resonator, except that special switches are used to induce phase quadrature in feeding the dielectric resonator. A dielectric disk resonator can be fed in a manner similar to a ferrite disk resonator shown in FIG. 2, and all of the switches used in FIG. 6 can be replaced by On-Off switches, in a manner relating FIG. 3 to FIG. 1. The outer feeder network, the dielectric resonator, and the inner feeder network may assume different substrate materials exhibiting different dielectric constants. The other discussions associated with FIG. 1 can be equally applied here, except that the phaser operation of FIG. 6 is fixed in frequency possessing no frequency tuning capability, as in contrast to the other ferrite examples considered with FIG. 1, FIG. 2, and FIG. 3.

CONCLUSIONS

Inner and outer feeder networks are applied collaboratively to a non-reciprocal resonator to derive, in multiplication, the selectivity in phase shift showing uniform operation. Inner feeder network assumes a radial branch consisting of M joining arms to be selected by On-Off switches, or an SPMT switch. Outer feeder network assumes an N-fold binary divider whose paths are selected via On-Off switches, SPDT switches, or special switches. This results in $2^N \cdot M$ total digital phases. To feed a dielectric ring/disk resonator is basically the same as to feed a ferrite ring/disk resonator, except that dual feeding is required at phase quadruature so as to induce non-reciprocity in wave propagation in the dielectric resonator. Non-reciprocity for wave propagation in the ferrite resonator is invoked by the applied bias magnetic field.

I claim:

1. A uniform coupling device to be installed with a nonreciprocal resonator showing a circular symmetry, comprising:

A) an outer feeder network consisting of an N-fold binary divider showing a circular symmetry coincident with that of said nonreciprocal resonator, where N is a non-negative integer, B) an inner feeder network consisting of a radial branch rendering M branch arms of an equal electrical length and a common vertex coincident with the center of said nonreciprocal resonator, where M is an integer no less than 1, C) electronic switches of a predetermined type or types at predetermined position or positions distributed with said outer feeder network, if N>0, and said inner feeder network, if M>1, to result $2^N$ paths and M paths, respectively;

wherein by electrically coupling in/out said outer feeder network and said inner feeder network with said nonreciprocal resonator, distinct overall electrical paths result, each of which is characterized by a unique phase with nominally the same insertion loss, thereby realizing the desired uniform coupling operation of said uniform coupling device.

2. The uniform coupling device of claim 1 wherein said nonreciprocal resonator results from magnetic bias of a ferrite medium loaded with said microwave nonreciprocal resonator.

3. The uniform coupling device of claim 1 wherein said nonreciprocal resonator results from phase-quadrature feeding at orthogonal positions activated by said electronic switches distributed with said outer feeder network.

4. The uniform coupling device of claim 1 wherein said radial branch shows a circular symmetry coincident with that of said nonreciprocal resonator.

5. The uniform coupling device of claim 1 wherein said distinct electrical paths include $M \cdot 2^N$ paths.

6. The uniform coupling device of claim 1 wherein said nonreciprocal resonator shows the shape of a disk or a ring assuming the microstrip, stripline, or inverted/suspended microstrip line geometries.

7. The uniform coupling device of claim 1 wherein said inner feeder network assumes the microstrip, stripline, or inverted/suspended microstrip line geometries, placed inside said nonreciprocal resonator showing the ring shape, or below/above said nonreciprocal resonator showing the disk shape.

8. The uniform coupling device of claim 1 wherein said outer feeder network assumes the microstrip, stripline, inverted/suspended microstrip line geometries, placed outside said nonreciprocal resonator showing the ring shape or the disk shape.

9. The uniform coupling device of claim 1 wherein electrically coupling in/out said outer feeder network and said inner feeder network with said nonreciprocal resonator means capacitive coupling, inductive coupling, and/or conductive coupling.

10. The uniform coupling device of claim 1 wherein said electronic switches incorporate semiconductor diodes, transistors, ferrites, ferroelectrics, and/or superconductors, activated via the application of an electric current, a voltage, a light, a temperature change, and/or a magnetic/electric field.

11. The uniform coupling device of claim 1 wherein said M branch arms do not necessarily to intersect all at one point; they may join each other first individually before leading to said common vertex.

12. The uniform coupling device of claim 1 wherein impedance transformers, amplifiers, and/or attenuators are included with said outer feeder network and/or said inner feeder network.

13. A method of obtaining uniform coupling onto a microwave nonreciprocal resonator showing a circular symmetry, comprising:

A) installing an outer feeder network consisting of an N-fold binary divider showing a circular symmetry coincident with that of said microwave nonreciprocal resonator, where N is a non-negative integer, B) if N>0, installing electronic switches of a predetermined type or types at predetermined position or positions distributed with said outer feeder network so that $2^N$ paths results, C) installing an inner feeder network consisting of a radial branch rendering M branch arms of an equal electrical length and a common vertex coincident with the center of said microwave nonreciprocal resonator, where M is an integer no less than 1, D) if M>1, installing electronic switches of a predetermined type or types at predetermined position or positions distributed with said inner feeder network so that M paths results, wherein by electrically coupling in/out said outer feeder network and said inner feeder network with said microwave nonreciprocal resonator, distinct electrical paths result, each of which is characterized by a unique phase with nominally the same insertion loss, thereby realizing said uniform coupling onto said microwave nonreciprocal resonator.

14. The method of claim 13 wherein said microwave nonreciprocal resonator results from magnetic bias of a ferrite medium loaded with said microwave nonreciprocal resonator.

15. The method of claim 13 wherein said microwave nonreciprocal resonator results from phase-quadrature feeding at orthogonal positions activated by said electronic switches distributed with said outer feeder network.

16. The method of claim 13 wherein said radial branch shows a circular symmetry coincident with that of said microwave nonreciprocal resonator.

17. The method of claim 13 wherein said distinct electrical paths include $M \cdot 2^N$ paths.

* * * * *